US007258240B2

(12) United States Patent
Wescott, III

(10) Patent No.: US 7,258,240 B2
(45) Date of Patent: Aug. 21, 2007

(54) BLOOD BANK TESTING WORKSTATIONS

(76) Inventor: Harvey M. Wescott, III, 37 Bart Rd., Billerica, MA (US) 01862

( * ) Notice: Subject to any disclaimer, the term of this patent is extended or adjusted under 35 U.S.C. 154(b) by 436 days.

(21) Appl. No.: 10/792,523

(22) Filed: Mar. 3, 2004

(65) Prior Publication Data

US 2005/0165287 A1 Jul. 28, 2005

Related U.S. Application Data

(63) Continuation-in-part of application No. 29/198,065, filed on Jan. 23, 2004, now Pat. No. Des. 506,833.

(51) Int. Cl.
*A47B 73/00* (2006.01)

(52) U.S. Cl. ..... 211/74; 211/85.18; 206/563

(58) Field of Classification Search ..... 211/74, 211/85.18, 85.13; 422/101, 104; 206/528, 206/438, 563, 558, 564, 363
See application file for complete search history.

(56) References Cited

U.S. PATENT DOCUMENTS 2,738,872 A * 6/1956 De Boton ..... 206/456
2,790,547 A * 4/1957 Sutton ..... 206/571
2,880,865 A * 4/1959 Knox ..... 206/456
3,379,315 A * 4/1968 Broadwin ..... 211/72
3,532,221 A * 10/1970 Kaluhiokalani et al. ... 211/70.6
3,604,566 A * 9/1971 Rem et al. ..... 211/74
3,778,232 A * 12/1973 McMorrow, Jr. ..... 422/65
4,040,234 A * 8/1977 Stockdale et al. ..... 53/471
4,124,122 A * 11/1978 Emmitt ..... 211/74
4,284,603 A * 8/1981 Korom ..... 422/101
4,407,958 A * 10/1983 DeGraff, Jr. ..... 435/283.1
4,453,639 A * 6/1984 Sharma ..... 211/74
4,495,150 A * 1/1985 Cook et al. ..... 422/99
4,588,095 A * 5/1986 Mehra ..... 211/74
5,080,232 A * 1/1992 Leoncavallo et al. ..... 206/446
5,133,939 A * 7/1992 Mahe ..... 422/104
5,169,603 A * 12/1992 Landsberger ..... 422/104
5,817,177 A * 10/1998 Wallace ..... 118/69
5,996,818 A * 12/1999 Boje et al. ..... 211/74
6,309,608 B1 * 10/2001 Zhou et al. ..... 422/131
6,568,544 B1 * 5/2003 Lafond et al. ..... 211/74

* cited by examiner

*Primary Examiner*—Jennifer E. Novosad
(74) *Attorney, Agent, or Firm*—John H. Pearson, Jr., Esq.; Walter F. Dawson, Esq.; Pearson & Pearson, LLP.

(57) ABSTRACT

A platform or workstation comprising a plurality of various size holes and slots for holding blood specimens, test tubes, gel-cards and reagent bottles in an organized arrangement to simplify testing of the blood specimens and to eliminate the likelihood of human error. The platform comprises a top plate, a middle plate and a bottom plate which are spaced apart in a parallel plates arrangement. The top plate and the middle plate each comprise a plurality of holes in a matrix configuration for receiving blood specimen tubes and test tubes, and one or more columns of slots adjacent to the matrix configuration of holes for receiving gel-cards. Other size holes are provided for receiving the reagent bottles. The workstation organizes blood specimens, test tubes and gel-cards in a row and stores reagents needed to perform tests using 57 holes of 3 sizes and 16 slots in a predetermined arrangement.

9 Claims, 15 Drawing Sheets

BLOOD BANK TESTING WORKSTATIONS

CROSS-REFERENCE TO RELATED APPLICATIONS

This is a continuation-in-part of Design Application No. 29/198,065, filed Jan. 23, 2004, now Design Patent No. D506,833.

BACKGROUND OF THE INVENTION

1. Field of the Invention

This invention relates generally to workstations or test platforms for use by laboratory technicians to perform tests on specimens of blood, and in particular to testing workstations or platforms having prearranged holes and slots for receiving various size specimen tubes, gel-cards, reagent tubes and/or reagent bottles in an organized manner on a workstation;

2. Description of Related Art

The introduction of new Gel-Technology in a blood bank laboratory made the standard workstations obsolete because the laboratory technologist could not handle both traditional test tubes and the new Gel-Technology on one workstation. A gel-card is a device which comprises six microtubes on one card having a bottom portion that is thin and extends the width of the gel-card which is typically 2¾ inches wide and 2¹⁄₁₆ inches high. Gel-cards were developed by Ortho-Clinical Diagnostics of Raritan, N.J. Instead the laboratory technologist was forced to use equipment which was not suited for the new gel-card technology and had to divide testing into sections or use multiple pieces of equipment which cluttered the work space making it cramped, confusing and error prone. Various errors were reported in determining a patient's blood type such as a confirming test not coinciding with an original test, specimens were misplanted, and test tubes which were previously next to each other were now separated in different areas. In particular, antibody screens, which had previously been done in test tubes next to the patient specimens, were now performed using the new gel-technology in a different location of the work space away from the specimens making it more difficult to match patients with the associated gel-cards. This problem caused errors in placing the wrong specimen in the gel-card or mismatching the patient with the gel-card, and mismatching antibodies with the patient.

A workstation, platform, or rack was needed which received traditional specimen tubes, test tubes, and new gel-cards and in other platforms the capability of receiving reagent bottles. Otherwise, the laboratory technologist was required to set-up patient specimens and their tests in different locations or different times, and it was time consuming and confusing for the technologist to remember what test had been completed and on what patient specimens. More equipment was needed in the work area to perform testing, causing the work area to become smaller, cluttered and confusing.

The following U.S. patents disclose various trays in the prior art for receiving test tubes and containers:

U.S. Pat. No. 2,790,547, issued Apr. 30, 1957 to Dorothy Jean Sutton, discloses a laboratory tray for use by laboratory medical technicians in medical diagnosis. The tray comprises several sections of different depths for stacking slides, for receiving hypodermic syringes, and syringe needles, for receiving clean pipettes or for miscellaneous supplies, and the tray comprises a panel having a plurality of apertures of varying dimensions to receive larger test tubes, smaller test tubes, jars for holding dry sponges or absorbent cotton, and solution bottles. However, this tray does not have slots for receiving gel-cards for testing purposes.

U.S. Pat. No. 2,880,865, issued Apr. 7, 1959 to David C. Knox, discloses a hematologist tray comprising an outer tray and an inner tray. The outer tray comprises a plurality of various apertures for receiving restriction tubes and holes to support bottles, beakers, etc. An inner tray comprises ten pairs of openings for receiving test tubes and adjacent to each pair of openings is a slot to receive a pair of slides. However, this tray does not have the capability of handling gel-cards.

U.S. Pat. No. 3,604,526, issued Sep. 14, 1971 to Douglas J. Rem, discloses a test tube holder comprising a plurality of apertures for portability and segregation of test tubes and protection of their contents. The holder comprises a U-shaped channeled base member and a C-shaped tube-retaining support member. The C-shaped member comprises a plurality of annular, axially aligned apertures wherein upper apertures are formed perpendicular to a top wall while lower apertures are formed perpendicularly of the bottom wall 28. Other embodiments show apertures only in the top wall and do not extend into the bottom wall for conveniently handling other devices of less height. However, again there is no capability of receiving gel-cards.

SUMMARY OF THE INVENTION

Accordingly, it is therefore an object of this invention to provide an efficiently organized arrangement of various size holes and slots for receiving patient specimen tubes, test tubes, gel-cards and/or reagent bottles in a prearranged row order to provide an efficient blood bank testing workstation.

It is another object of this invention to provide a blood bank testing workstation for laboratory technologists to perform blood testing operations in a manner that eliminates the likelihood of human errors.

These and other objects are accomplished by a blood bank testing workstation comprising a top plate spaced above a middle plate and the middle plate spaced above a bottom plate, each of the top plate and the middle plate comprises a matrix of holes, the matrix of holes in the top plate being aligned with the matrix of holes in the middle plate, a column of slots in the top plate positioned adjacent to the matrix of holes in the top plate, and a column of slots in the middle plate positioned adjacent to the matrix of holes in the middle plate and aligned directly under the column of slots in the top plate. The workstation comprises a plurality of rows in the top plate and corresponding holes in the middle plate, each row comprises a first size hole of the matrix of holes, a plurality of second size holes of the matrix of holes, and a slot. The column of slots in the top plate comprises a through slot, and the column of slots in the middle plate comprises a non-through slot. The matrix of holes comprises a first column of a first size holes for receiving blood specimen tubes and an adjacent array of second size holes for receiving test tubes. The platform comprises a plurality of screws for securing the top plate, the middle plate and the bottom plate together, the screws being inserted in first spacers between the top plate and the middle plate and second spacers between the middle plate and the bottom plate. The plurality of screws are screwed into standoffs on the bottom of the bottom plate.

The workstation comprises a plurality of third size through holes in the first plate and positioned behind the column of slots, and a plurality of the third size holes in the middle plate aligned under the corresponding third size holes in the top plate, the third size holes in the middle plate being non-through holes. An array of second size holes are positioned both in front of and behind the third size holes for supporting test tubes inserted in the top plate and the middle plate.

The workstation comprises a second column of slots in the top plate adjacent to the first column of slots, and a second column of slots in the middle plate positioned adjacent to the first column of slots and aligned directly under the second column of slots in the top plate. The workstation comprises a plurality of third size through holes in the first plate behind the matrix of holes, and a plurality of the third size holes in the middle plate aligned under the corresponding third size holes in the top plate, the third size holes in the middle plate being non-through holes. A row of second size holes are positioned on the top plate in the same row as the third size holes and behind the first column and the second column of slots, and a row of the second size holes are positioned in the middle plate aligned under the corresponding second size holes in the top plate. The workstation comprises in the top plate a second column of slots adjacent to the first column of slots and a third column of slots adjacent to the second column of slots, and in the middle plate a second column of slots adjacent to the first column of slots and a third column of slots adjacent to the second column of slots, all slots in the middle plate being aligned under all corresponding slots in the top plate.

The workstation comprises in the top plate a plurality of third size holes arranged in two rows behind the matrix of holes adjacent to the first, second and third column of slots, and in the middle plate aligned under the top plate are a plurality of the third size holes arranged in two rows behind the matrix of holes adjacent to the first, second and third column of slots. Each of the plurality of third size holes in the middle plate comprises non-through holes with a second size hole extending through the center of the third size holes. The two rows of the third size holes are staggered with respect to each of the two rows.

Additional objects, features and advantages of the invention will become apparent to those skilled in the art upon consideration of the following detailed description of the preferred embodiments exemplifying the best mode of carrying out the invention as presently perceived.

BRIEF DESCRIPTION OF THE DRAWINGS

The appended claims particularly point out and distinctly claim the subject matter of this invention. The various objects, advantages and novel features of this invention will be more fully apparent from a reading of the following detailed description in conjunction with the accompanying drawings in which like reference numerals refer to like parts, and in which:

DESCRIPTION OF ILLUSTRATIVE EMBODIMENTS

Figure 1:
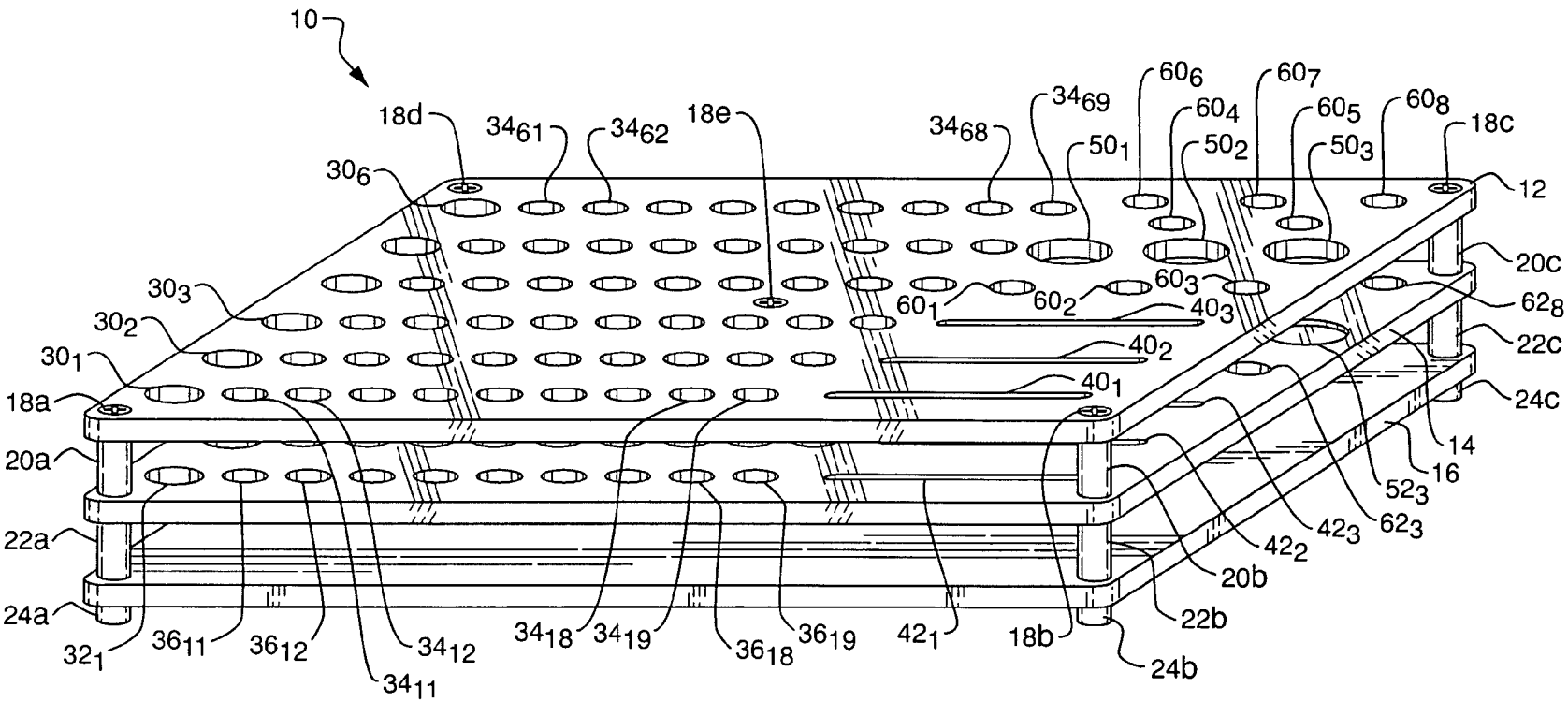
FIG. 1 is a front perspective view of a TS6 platform according to the invention.
Figure 2:
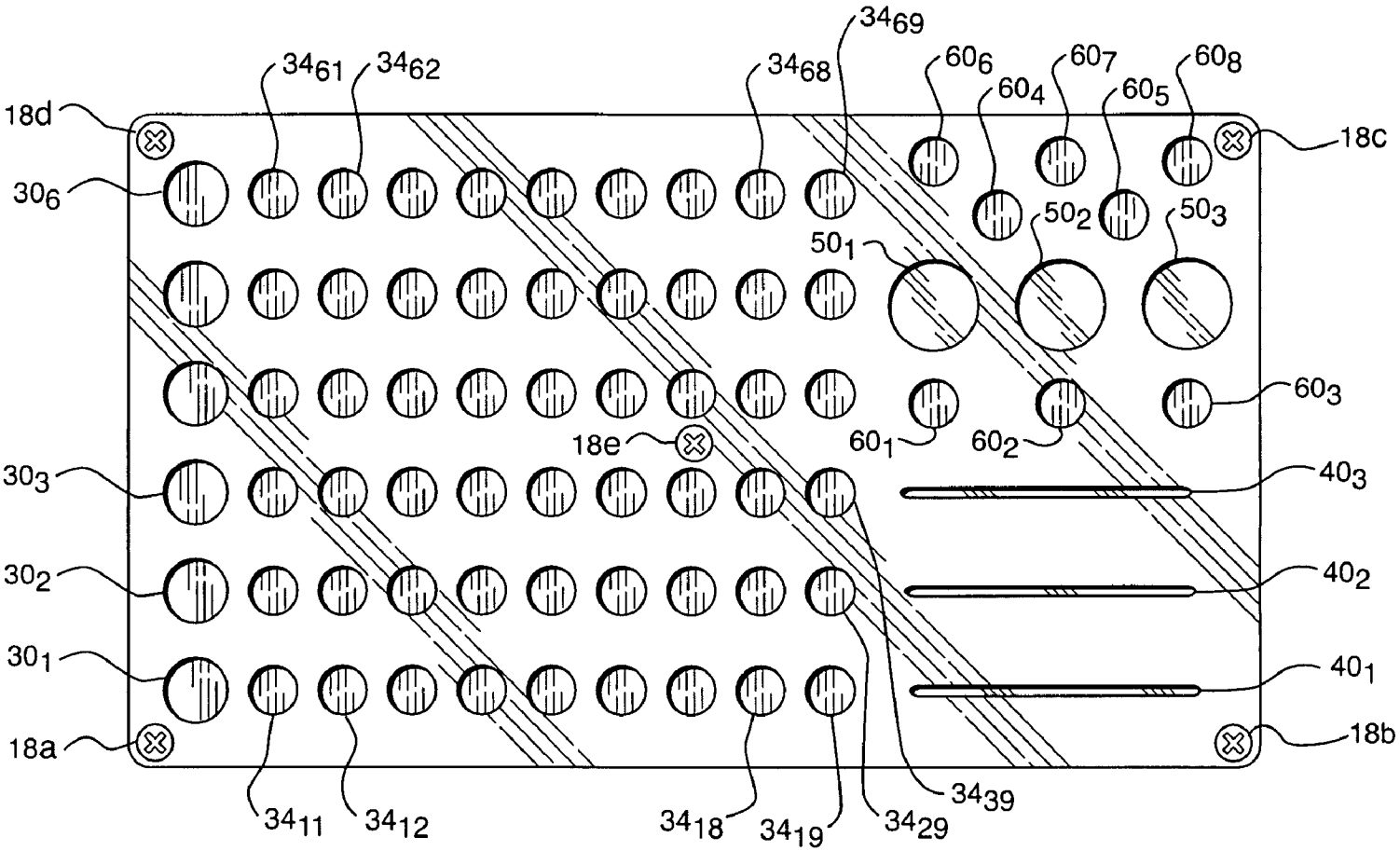
FIG. 2 is a top plan view of the TS6 platform.
Figure 3:
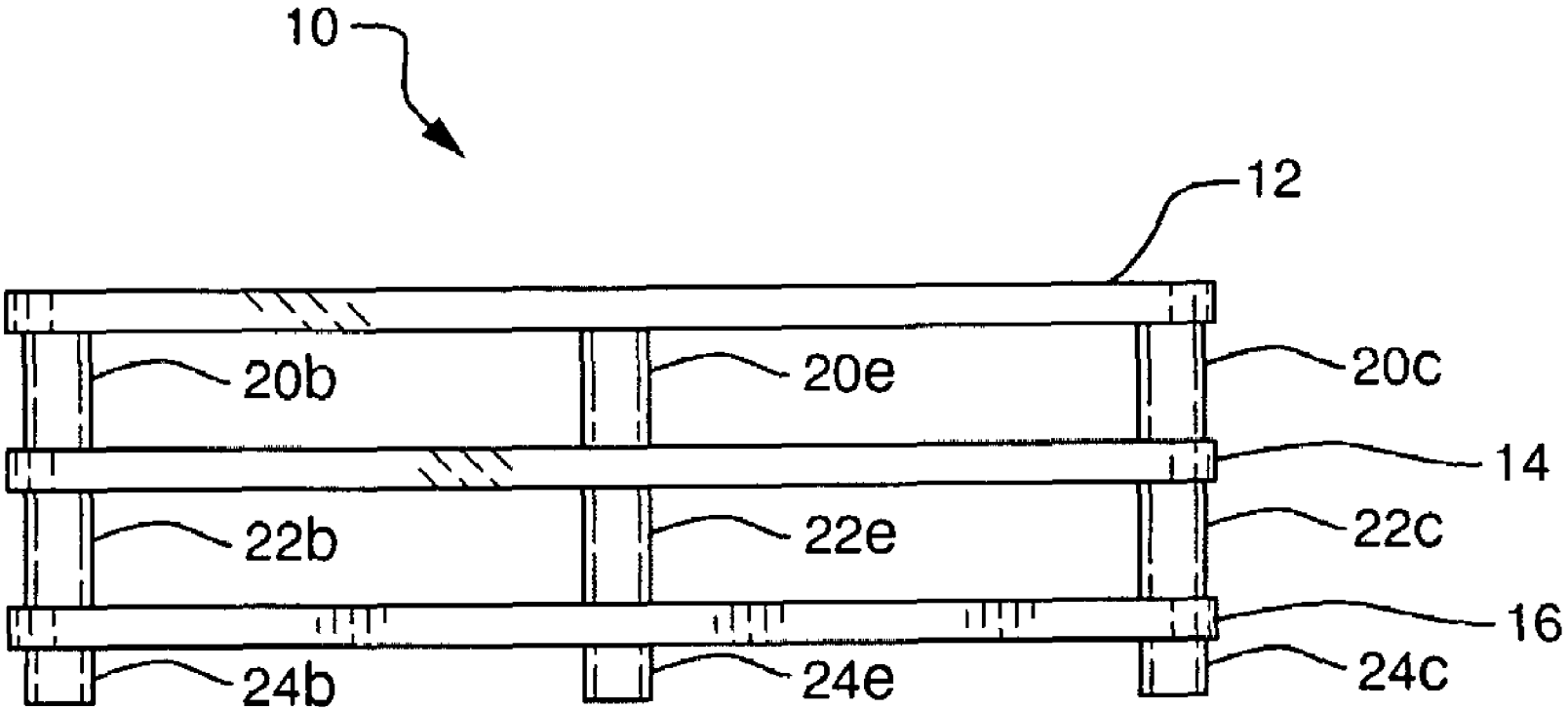
FIG. 3 is a right side elevational view of the TS6 platform.

Referring to FIG. 1, FIG. 2 and FIG. 3, FIG. 1 is a perspective view of a six (6) specimen testing (TS6) platform or workstation 10 according to the present invention, which is used for blood bank testing and in particular ABORH, DAT and X-match tests. FIG. 2 is a top plan view of the platform 10, and FIG. 3 is a right side elevational view of the TS6 platform 10. The testing platform 10 comprises a top plate 12, a middle plate 27 and a bottom plate 28 in separate, spaced apart horizontal planes parallel to each other. A first set of spacers 20*a*-20*e* are positioned around screws 18*a*-18*e* between the top plate 12 and the middle plate 14, and a second set of spacers 22*a*-22*e* are positioned around screws 18*a*-18*e* between the middle plate 14 and the bottom plate 28. Shorter spacers or standoffs 24*a*-24*e* on the bottom side of the bottom plate 28 are screwed on the ends of screws 18*a*-18*e* which are inserted into holes on the corners and center of the top plate 12, middle plate 14, and bottom plate 16. The standoff 24*e* may be made slightly shorter than standoffs 24*a*-24*d* to prevent rocking of the platform 10 while on a flat surface during use.

In top plate 12 of the illustrative embodiment a column of six holes $\mathbf{30}_1$-$\mathbf{30}_6$ are provided each 16 mm in diameter, and an array or matrix of fifty-four (54) smaller holes $\mathbf{34}_{11}$-$\mathbf{34}_{69}$ are provided each 12.5 mm in diameter. This matrix of small holes $\mathbf{34}_{11}$-$\mathbf{34}_{69}$ comprises 9 holes in each row and 6 holes in each column as shown in FIG. 2. Likewise, the middle plate 12 comprises a column of six holes $\mathbf{32}_1$-$\mathbf{32}_6$ each 16 mm in diameter suitable for receiving blood specimen tubes, and the fifty-four smaller holes $\mathbf{36}_{11}$-$\mathbf{36}_{69}$ each 12.5 mm in diameter are suitable for receiving standard test tubes.

Still referring to FIG. 1 and FIG. 2, the top plate 12 and the middle plate 14 each comprise a total of seventy-one (71) holes and each hole in the top plate 12 is axially aligned directly above a correspondingly positioned hole in the middle plate 14. For example, hole $\mathbf{30}_1$ in a first row of the top plate 12 is directly above hole $\mathbf{32}_1$ in the middle plate. Likewise, in the same first row smaller holes $\mathbf{34}_{11}$-$\mathbf{34}_{69}$ in the top plate are directly above corresponding holes $\mathbf{36}_{11}$-$\mathbf{36}_{69}$ in the middle plate 14.

In addition to the column of 6 holes $\mathbf{30}_1$-$\mathbf{30}_6$ and matrix of 54 smaller holes $\mathbf{34}_{11}$-$\mathbf{34}_{69}$ in the top plate 12 and the column of 6 holes $\mathbf{32}_1$-$\mathbf{32}_6$ and matrix of 54 smaller holes $\mathbf{36}_{11}$-$\mathbf{36}_{69}$ in the middle plate 14, another portion of the platform 10 comprises a column of three slots $\mathbf{40}_1$-$\mathbf{40}_3$ in the top plate 12 each slot being in a row adjacent to holes $\mathbf{34}_{19}$, $\mathbf{34}_{29}$ and $\mathbf{34}_{39}$ respectively. Likewise, there are three slots $\mathbf{42}_1$-$\mathbf{42}_3$ in the middle plate 14 located and aligned directly under the slots $\mathbf{40}_1$-$\mathbf{40}_3$ in the top plate 12. The slots $\mathbf{40}_1$-$\mathbf{40}_3$ in the top plate 12 of the illustrated embodiment measure 2 mm×72 mm, extend completely through the top plate 12, and are sized for receiving a standard gel-card. The slots $\mathbf{40}_1$-$\mathbf{40}_3$ in the middle plate 14 are not cut completely through the middle plate 14 and measure 2 mm×72 mm with a depth of approximately 3 mm which is sufficiently deep to retain a bottom edge of a gel-card. This enables a gel-card, inserted into slots $40_1$-$40_3$ and $42_1$-$42_3$, to extend above the top plate 12 for ease of use of the microtubes and to allow information on the gel-card to be easily read. The first three rows in the top plate 12 of platform 10 each comprise a larger hole such as hole 30, in the first row, a series of smaller holes such as holes $34_{11}$-$34_{19}$ and a slot such as slot $40_1$, which together provide an organized, efficient arrangement for performing blood bank testing. Similarly the first three rows of the middle plate 14 comprise a larger hole such as hole $32_1$ in the first row, a series of smaller holes, such as holes $36_{11}$-$36_{19}$, and a slot, such as slot $42_1$, and each row of holes and slots is aligned under the corresponding holes and slots in top plate 12.

Still referring to FIGS. 1 and 2, the top plate 12 and the middle plate 14 comprise three holes $60_1$-$60_3$, and $62_1$-$62_3$ respectively behind slot $40_3$ in the top plate 12 and $42_3$ in the middle plate 14 which are each 12.5 mm in diameter suitable for receiving test tubes or reagent tubes. Behind holes $60_1$-$60_3$ on the top plate 12 and the holes $62_1$-$62_3$ on the middle plate 14 are three larger holes $50_1$-$50_3$ on the top plate 12 and holes $52_1$-$52_3$ on the middle plate 14. Each of these larger holes $50_1$-$50_3$ and $52_1$-$52_3$ are 25 mm in diameter and are provided for conveniently holding articles such as reagent bottles. However, holes $52_1$-$52_3$ in the middle tray 14 are not through holes, but instead they are cut out to a depth of approximately 3 mm, which enables articles such as reagent bottles inserted into holes $50_1$-$50_3$ and partial holes $52_1$-$52_3$ to extend higher above the top plate 12 of platform 10. Behind the 25 mm holes $50_1$-$50_3$ and $52_1$-$52_3$ are five holes $60_4$-$60_8$ in the top plate 12 and correspondingly aligned holes $62_4$-$62_8$ in the middle plate 14. These five holes are 12.5 mm in diameter and are staggered in two rows with holes $60_4$, $60_5$ being forward and holes $60_6$, $60_7$ and $60_8$ being back of holes $60_4$, $60_5$ along the back edge of top plate 12 as shown in FIGS. 1 and 2, and likewise, on the middle plate 14 holes $62_4$ and $62_5$ are forward and holes $62_6$, $62_7$ and $62_8$ are back along the rear edge of middle plate 14. These 12.5 mm holes $60_4$-$60_8$ are provided to store useful articles such as balance tubes, pens, scissors, pipette, etc. The solid bottom plate 16 serves as a stop underneath the middle plate for articles that extend through the holes in the middle plate 14.

The workstation or testing platform 10 is designed structurally to avoid making errors in a hospital blood bank, to simplify and speed-up the workflow process, and to better organize the workflow and conserve bench space. It allows a laboratory technologist to organize in a safe and efficient manner all the necessary testing tubes including a patient specimen tube in a single row along with a gel-card, which makes the testing visually and physically easier to perform. Having the slots $40_1$-$40_3$ on the top plate 12 and slots $42_1$-$42_3$ on the middle plate 14 for receiving gel-cards on the testing platform 10 eliminates the need for another secondary workstation making it easier for a technologist to see and load the microtubes of the gel-card and avoid an error of planting a patient blood specimen in the wrong gel-card.

Referring again to FIG. 1, the top plate 12 and the middle plate 14 are made of plastic and may be embodied by a Lexan® polycarbonate, manufactured by General Electric Company, or by a Hyzod® polycarbonate manufactured by Sheffield Plastics, Inc. The top plate 12 and the middle plate 14 are machined together to insure alignment of holes and slots by a CNC milling machine. The bottom plate 16 may be embodied by a plastic made of a high density polyethylene.

Figure 4:
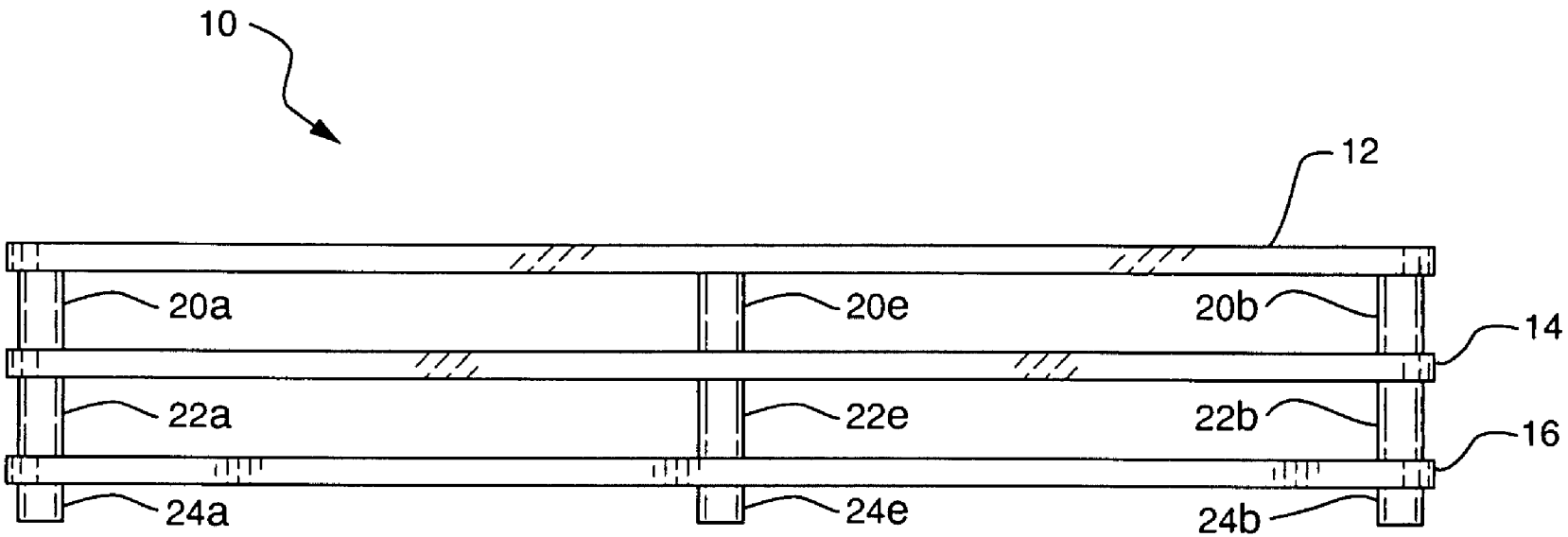
FIG. 4 is a front elevational view of the TS6 platform.

Referring to FIG. 2 and FIG. 4, FIG. 4 is a front elevational view of the testing platform 10 showing the front left corner spacers 20*a*, 22*a*, the front right corner spacers 20*b*, 22*b*, and center spacers 20*e*, 22*e*. The center spacers 20*e*, 22*e* are located approximately in the center of the platform 10. The screws 18*a*-18*d* at the corners of the platform 10 and the center screw 18*e* may be embodied by commonly available stainless steel, flat head, Phillips machine screws having a 10-32 thread and a length of 2.5 inches. The spacers 20*a*-20*e*, 22*a*-22*e* at the four corners and the center of the platform 10 may be embodied by commonly available Nylon unthreaded round spacers having a ⅜ inch O.D., ¾ inch length #10 screw size.

Figure 5:
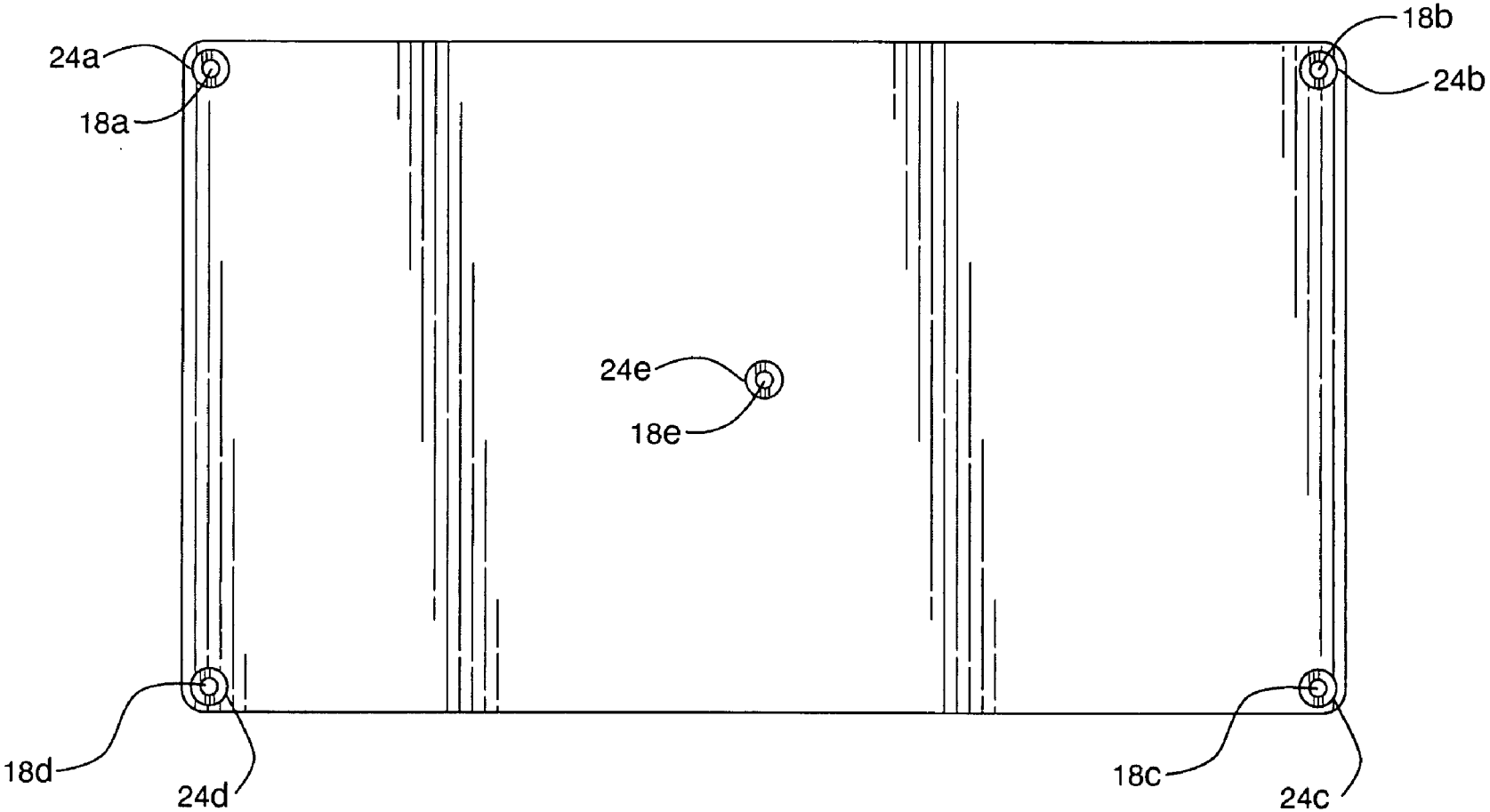
FIG. 5 is a bottom plan view of the TS6 platform.

Referring to FIG. 1 and FIG. 5, FIG. 5 shows a bottom plan view of the testing platform 10 comprising the bottom plate 16 and standoffs 24*a*-24*e*. The standoffs 24*a*-24*e* are threaded and screwed onto the ends of the 10-32 screws 18*a*-18*e*. The standoffs 24*a*-24*e* are commonly available nylon threaded, round standoffs having a ⅜ inch O.D., ⅜ inch length and 10-32 thread. As previously described, the bottom plate 16 provides a stop for articles such as specimen tubes or test tubes inserted into holes in the platform 10.

The TS6 platform 10 as shown in FIG. 1 measures 11.25 inches×6.5 inches×2.5 inches and is intended to accommodate six (6) patient specimens which are received by top plate holes $30_1$-$30_6$ and bottom plate holes $32_1$-$32_6$. However, one of ordinary skill in the art will recognize that other dimensions for the TS6 platform 10 may be implemented depending on a user laboratory requirement or preference without departing from the invention.

GEL8 Workstation

Figure 6:
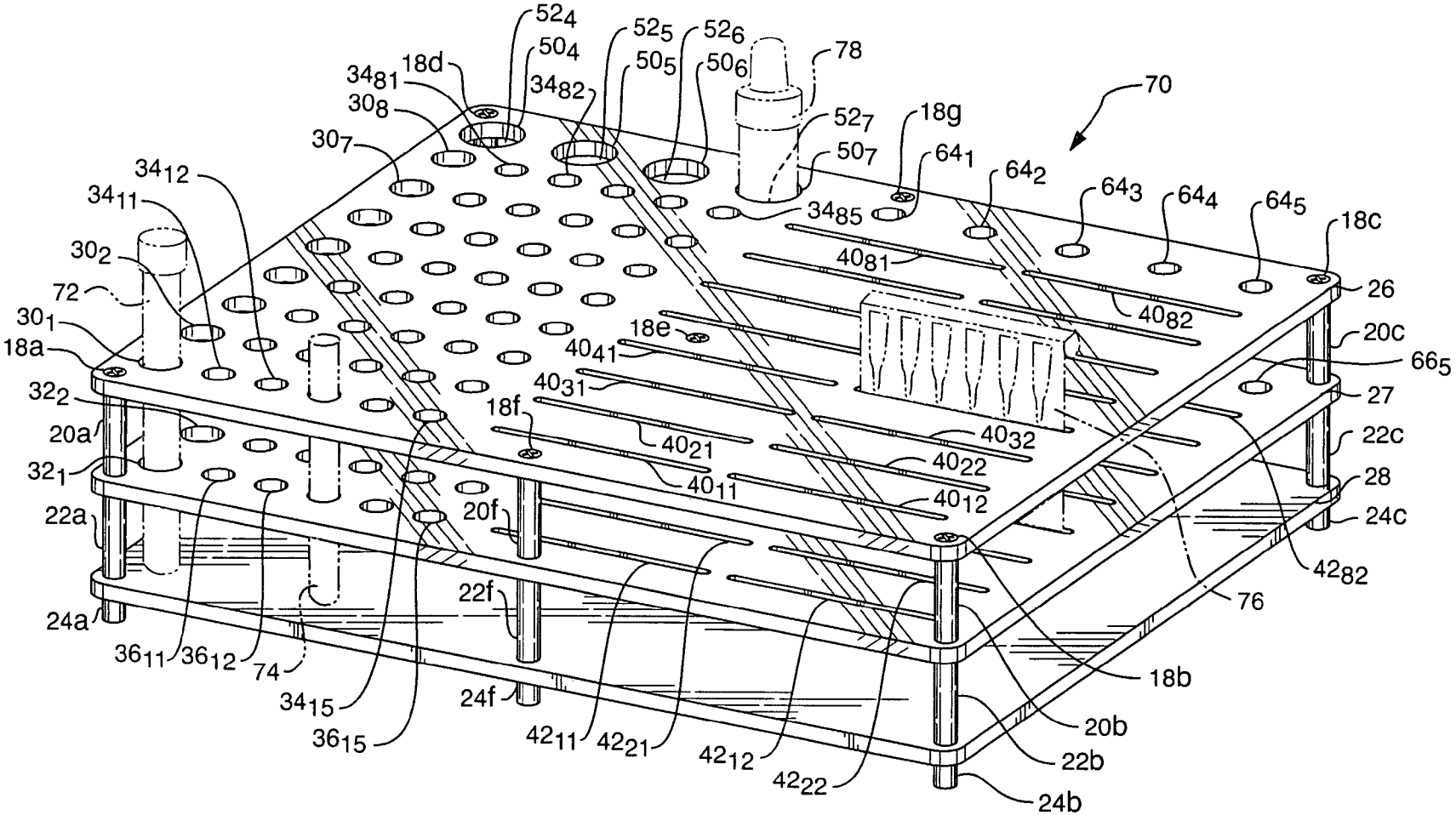
FIG. 6 is a front perspective view of a second embodiment or GEL8 blood bank testing workstation according to the invention.
Figure 7:
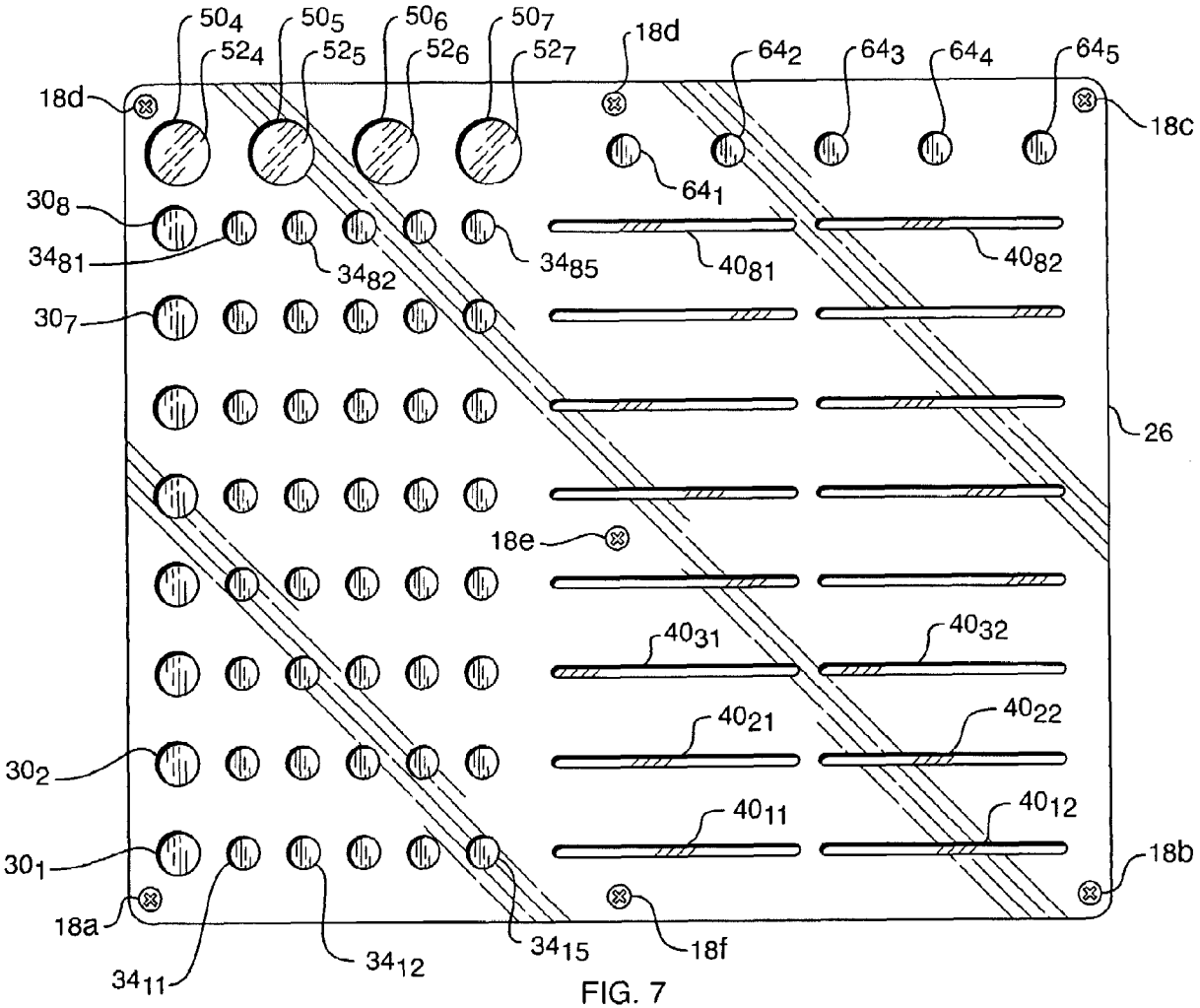
FIG. 7 is a top plan view of the GEL8 workstation.
Figure 8:
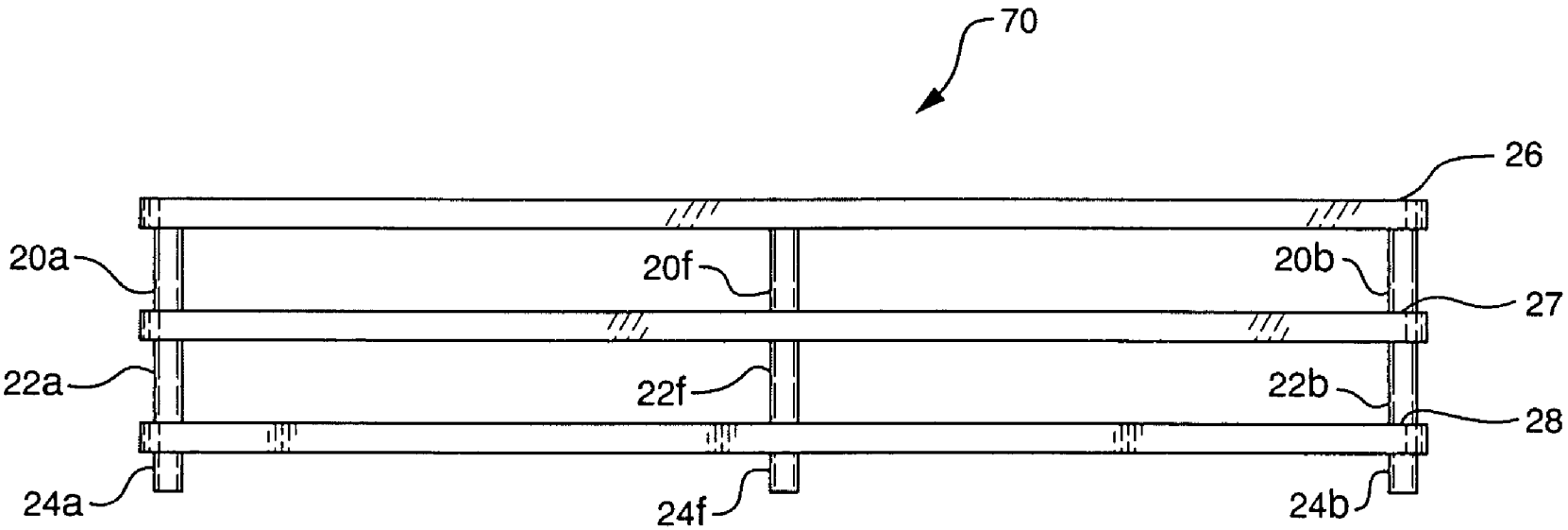
FIG. 8 is a front elevational view of the GEL8 workstation.

Referring to FIG. 6, FIG. 7 and FIG. 8, FIG. 6 is a perspective view of a second embodiment of the blood bank testing workstations comprising an eight (8) specimen testing platform or workstation 70 according to the present invention, and it is referred to as a GEL8 workstation 70 comprising two columns of slots $40_{11}$-$40_{81}$ and $40_{12}$-$40_{82}$ for receiving gel-cards 76 and used for blood bank testing. FIG. 7 is a top plan view of the GEL8 workstation 70, and FIG. 8 is a front elevational view of the GEL8 workstation 70. The GEL8 workstation 70 comprises a top plate 26, a middle plate 27 and a bottom plate 28 arranged in separate, spaced apart horizontal planes parallel to each other. A first set of spacers 20*a*-20*g* are positioned around screws 18*a*-18*g* between the top plate 26 and the middle plate 27, and a second set of spacers 22*a*-22*g* are positioned around screws 18*a*-18*g* between the middle plate 27 and the bottom plate 28. Shorter spacers or standoffs 24*a*-24*g* on the bottom side of the bottom plate 28 are screwed on the ends of screws 18*a*-18*g* which are inserted into holes on the corners and across the center of the top plate 26, the middle plate 27, and the bottom plate 28. The standoffs 24*e*-24*g* may be made slightly shorter than the corner standoffs 24*a*-24*d* to prevent rocking of the workstation 70 while on a flat surface during use.

The top plate 26 of the illustrative embodiment comprises a column of eight holes $30_1$-$30_8$ each 16 mm in diameter, and an array or matrix of forty (40) smaller holes $34_{11}$-$34_{81}$ are provided each hole being 12.5 mm in diameter. This matrix of smaller holes $34_{11}$-$34_{81}$ comprises 5 holes such as $34_{11}$-$34_{15}$ in each row and 8 holes such as $34_{11}$-$34_{81}$ in each column. Likewise, in the middle plate 27 the eight holes $32_1$-$32_8$ are 16 mm in diameter suitable for receiving blood specimen tubes 72, and the forty (40) smaller holes $\mathbf{36}_{11}$-$\mathbf{36}_{85}$ are 12.5 mm in diameter, suitable for receiving standard test tubes 74.

Still referring to FIG. 1 and FIG. 2, the top plate 26 and the middle plate 27 each comprise fifty-seven (57) holes and each hole in the top plate 26 is axially aligned directly above a correspondingly positioned hole in the middle plate 27. For example, hole $\mathbf{30}_1$, in a first row of the top plate 26 is directly above hole $\mathbf{32}_1$, in the middle plate 27. Likewise, in the same first row smaller holes $\mathbf{34}_{11}$-$34_{15}$ in the top plate 26 are directly above corresponding holes $\mathbf{36}_{11}$-$\mathbf{36}_{15}$ in the middle plate 27. Behind the eighth row in top plate 26, which comprises hole $\mathbf{30}_8$ and smaller holes $\mathbf{36}_{81}$-$\mathbf{36}_{85}$, are four (4) larger holes $\mathbf{50}_4$-$\mathbf{50}_7$ which are 25 mm in diameter. Likewise, in the middle plate 27 corresponding holes $\mathbf{52}_4$-$\mathbf{52}_7$ are partial non-through holes which are 25 mm in diameter and approximately 3 mm deep, and they are axially aligned directly under holes $\mathbf{50}_4$-$\mathbf{50}_7$ in the top plate 26. The larger holes $\mathbf{50}_4$-$\mathbf{50}_7$ are provided to hold reagent bottles 78.

In addition to the fifty-seven (57) holes in the top plate 26 and fifty-seven 57 holes in the middle plate 27, the first column of eight slots $\mathbf{40}_{11}$-$\mathbf{40}_{81}$ is provided in the top plate 26, and the column of corresponding slots $\mathbf{42}_{11}$-$\mathbf{42}_{81}$ is provided in the middle plate 27, the slots $\mathbf{40}_{11}$-$\mathbf{40}_{81}$ in the top plate 26 being aligned directly above corresponding slots $\mathbf{42}_{11}$-$\mathbf{42}_{81}$ in the middle plate 27. The slots $\mathbf{40}_{11}$-$\mathbf{40}_{81}$ in the top plate 26 of the illustrated embodiment measure 2 mm×72 mm, extend completely through the top plate 26, and are sized for receiving a standard gel-card. The slots $\mathbf{42}_{11}$-$\mathbf{42}_{81}$ in the middle plate 27 are not cut completely through the middle plate 27 and measure 2 mm×72 mm with a depth of approximately 3 mm. This enables the gel-card 76 inserted in one of the slots $\mathbf{40}_{11}$-$\mathbf{40}_{81}$ to extend above the top plate 26 for ease of use of the microtubes and to allow information on the gel-card to be easily read. Further, in the top plate 26 there is a second column of eight slots $\mathbf{40}_{12}$-$\mathbf{40}_{82}$ adjacent to the first column of eight slots $\mathbf{40}_{11}$-$\mathbf{40}_{81}$ to accommodate a second column of gel-cards 76. Likewise, on the middle plate 27 slots $\mathbf{42}_{12}$-$\mathbf{42}_{82}$ are provided adjacent to the first column of eight slots $\mathbf{42}_{11}$-$\mathbf{42}_{81}$, and slots $\mathbf{42}_{12}$-$\mathbf{42}_{82}$ are aligned directly under slots $\mathbf{40}_{12}$-$\mathbf{40}_{82}$. Again, slots $\mathbf{42}_{12}$-$\mathbf{42}_{82}$ in the middle plate 27 are not cut completely through the middle plate 27 and measure 2 mm×72 mm with a depth of approximately 3 mm. This enables the microtubes in the gel-card 76 inserted in one of the slots $\mathbf{40}_{12}$-$\mathbf{40}_{82}$ to be easily accessed and information on the gel-card to be easily read. Each row of holes in workstation 70 such as the row in the top plate 12 with holes $\mathbf{30}_1$ and $\mathbf{34}_{11}$-$\mathbf{34}_{15}$ comprises slots $\mathbf{40}_{11}$ and $\mathbf{40}_{12}$, and likewise each row of holes in the middle plate 27 such as the row with holes $\mathbf{32}_1$ and $\mathbf{36}_{11}$-$\mathbf{36}_{15}$ comprises the partial slots $\mathbf{42}_{11}$ and $\mathbf{42}_{12}$.

The GEL8 workstation 70 comprises in plate 26 two holes $\mathbf{64}_1$, $\mathbf{64}_2$ each 12.5 mm in diameter behind the last slot $\mathbf{40}_{81}$ in the first column of slots $\mathbf{40}_{11}$-$\mathbf{40}_{81}$. Likewise, in the middle plate 27, there are two holes $\mathbf{66}_1$ and $\mathbf{66}_2$ each 12.5 mm in diameter behind the last slot $\mathbf{42}_{81}$ in the first column of slots $\mathbf{40}_{11}$-$\mathbf{40}_{81}$ and holes $\mathbf{66}_1$ and $\mathbf{66}_2$ are axially aligned under holes $\mathbf{64}_1$ and $\mathbf{64}_2$ in the top plate 26. Further, in plate 26 there are three holes $\mathbf{64}_3$, $\mathbf{64}_4$ and $\mathbf{64}_5$ each 12.5 mm in diameter behind the last slot $\mathbf{40}_{82}$ in the second column of slots $\mathbf{40}_{12}$-$\mathbf{40}_{82}$ Likewise, in the middle plate 27 there are three holes $\mathbf{66}_3$, $\mathbf{66}_4$ and $\mathbf{66}_5$ each 12.5 mm in diameter behind the last slot $\mathbf{42}_{82}$ in the second column of slots $\mathbf{42}_{12}$-$\mathbf{42}_{82}$. The top plate 26 holes $\mathbf{64}_3$-$\mathbf{64}_5$ are axially aligned above the middle plate holes $\mathbf{66}_3$-$\mathbf{66}_5$ for certain other applications. The 12.5 mm holes $\mathbf{64}_1$-$\mathbf{64}_5$ in the top plate 26 and corresponding holes $\mathbf{66}_1$-$\mathbf{66}_5$ in middle plate 27 may be changed to 25 mm holes in the workstation 70 depending on laboratory user requirements.

The workstation 70 is designed structurally to avoid making errors in a hospital blood bank, to simplify and speed-up the workflow process, and to better organize the workflow and conserve bench space. It allows a laboratory technologist to organize in a safe and efficient manner all the necessary testing tubes including a patient specimen tube in a single row along with a gel-card, which makes the testing visually and physically easier to perform. Having the two columns of 16 slots $\mathbf{40}_{11}$-$\mathbf{40}_{81}$ and slots $\mathbf{40}_{12}$-$\mathbf{40}_{82}$ on the top plate 26 and slots $\mathbf{42}_{11}$-$\mathbf{42}_{81}$ and slots $\mathbf{42}_{12}$-$\mathbf{42}_{82}$ on the middle plate 27 for receiving gel-cards 76 on the workstation 70 eliminates the need for another secondary workstation making it easier for a technologist to see and load the microtubes of the gel-card 76 and avoid an error of planting a patient blood specimen in the wrong gel-card.

The advantage of this workstation 70 is that it allows the technologist to centralize testing on one workstation instead of 2 to 3. It also allows the technologist to organize the specimen tubes 72, test tubes 74 and gel-card 76 in line with each other, making them easier to see and to add reagents/cells without contaminating other tests within the rack. Workstation 70 stores all the reagent bottles 78 needed to perform testing eliminating the need to have reagent bottles 78 in a separate platform. This conserves reagents as their shelf life is diminished when left at room temperature, and conserves on bench space. The workstation 70 also lines up the reagent bottles 78 where they are needed. Reagents bottles 78 are aligned with test tubes 74 and reagent cell tubes are located in holes $\mathbf{64}_1$-$\mathbf{64}_5$ behind the gel-cards $\mathbf{40}_{81}$ and $\mathbf{40}_{82}$ which use those specific cells. As described above, the five 12.5 mm holes $\mathbf{64}_1$-$\mathbf{64}_5$ located behind gel-cards $\mathbf{40}_{81}$ and $\mathbf{40}_{82}$ can be changed to 25 mm holes which accommodate reagent bottles for labs which do not dilute their own cells, or aliquot from reagent bottles into test tubes.

Referring again to FIG. 6, the top plate 26 and the middle plate 27 are made of plastic and may be embodied by a Lexan® polycarbonate, manufactured by General Electric Company, or by a Hyzod® polycarbonate manufactured by Sheffield Plastics, Inc. The top plate 12 and the middle plate 14 are machined together to insure alignment of holes and slots by a CNC milling machine. The bottom plate 28 may be embodied by a plastic made of a high density polyethylene.

Referring to FIG. 7 and FIG. 8, FIG. 8 is a front elevational view of the workstation 70 showing the front left corner spacers 20*a*, 22*a*, the front right corner spacers 20*b*, 22*b*, and front spacers 20*f*, 22*f*. There are center spacers 20*e*, 22*e* located approximately in the center of the workstation 70, and rear spacers 20*g*-22*g* (not shown) located in the rear center of the workstation 70. The screws 18*a*-18*g* at the corners and center corner of the workstation 70 may be embodied by commonly available stainless steel, flat head, Phillips machine screws having a 10-32 thread and a length of 2.5 inches. The spacers 20*a*-20*g*, 22*a*-22*g* at the four corners and the center areas of the workstation 70 may be embodied by commonly available Nylon unthreaded, round spacers having a ⅜ inch O.D., ¾ inch length #10 screw size.

Figure 9:
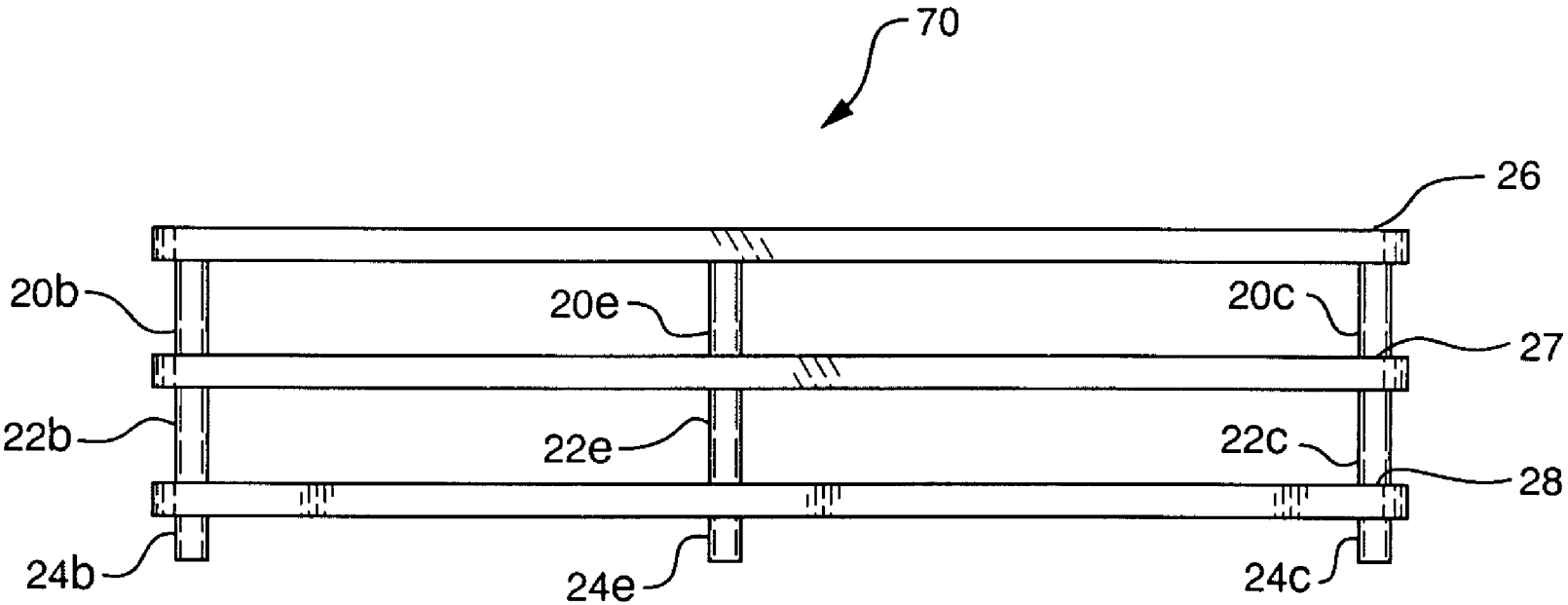
FIG. 9 is a right side elevational view of the GEL8 workstation.

Referring to FIG. 6 and FIG. 9, FIG. 9 is a right side elevation view of the GEL8 workstation 70 showing the spacers 20*e*, 22*e* and standoff 24*e*, which are located between the slots $\mathbf{40}_{31}$ and $\mathbf{40}_{41}$, are slightly toward the front of the workstation 70 between the front spacers 20*f*, 22*f* and rear spacers 20*g* and 22*g*.

Figure 10:
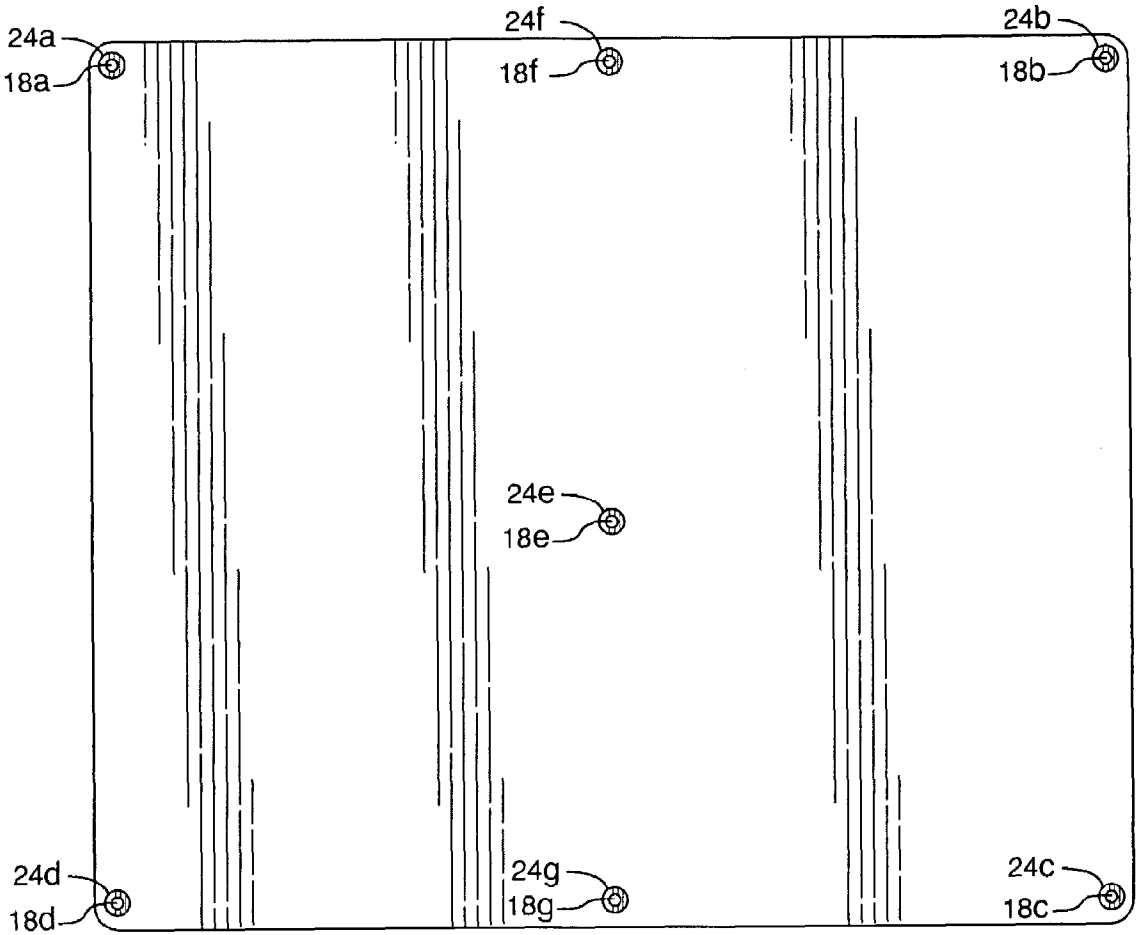
FIG. 10 is a bottom plan view of the GEL8 workstation.

Referring to FIG. 6 and FIG. 10, FIG. 10 shows a bottom plan view of the GEL8 workstation 70 comprising the bottom plate 28 and standoffs 24*a*-24*g*. The standoffs 24*a*-24*g* are threaded and screwed onto the ends of the 10-32 screws 18*a*-18*g*. The standoffs 24*a*-24*g* are commonly available nylon threaded, round standoffs having a ⅜ inch O.D., ⅜ inch length and 10-32 thread. As previously described, the bottom plate 28 provides a stop for articles such as specimen tubes 72 or test tubes 74 inserted into holes $\mathbf{30}_1$-$\mathbf{30}_8$ and $\mathbf{34}_{12}$-$\mathbf{34}_{85}$ respectively in the workstation 70.

The GEL8 workstation 70 as shown in FIG. 6 measures 11.25 inches×9.5 inches×2.5 inches and is intended to accommodate eight (8) patient specimen tubes 72 which are received by top plate holes $\mathbf{30}_1$-$\mathbf{30}_8$ and middle plate holes $\mathbf{32}_1$-$\mathbf{32}_8$. However, one of ordinary skill in the art will recognize that other dimensions of the GEL8 workstation 70 may be implemented depending on a user laboratory requirement or preference without departing from the invention.

CU Workstation

Figure 11:
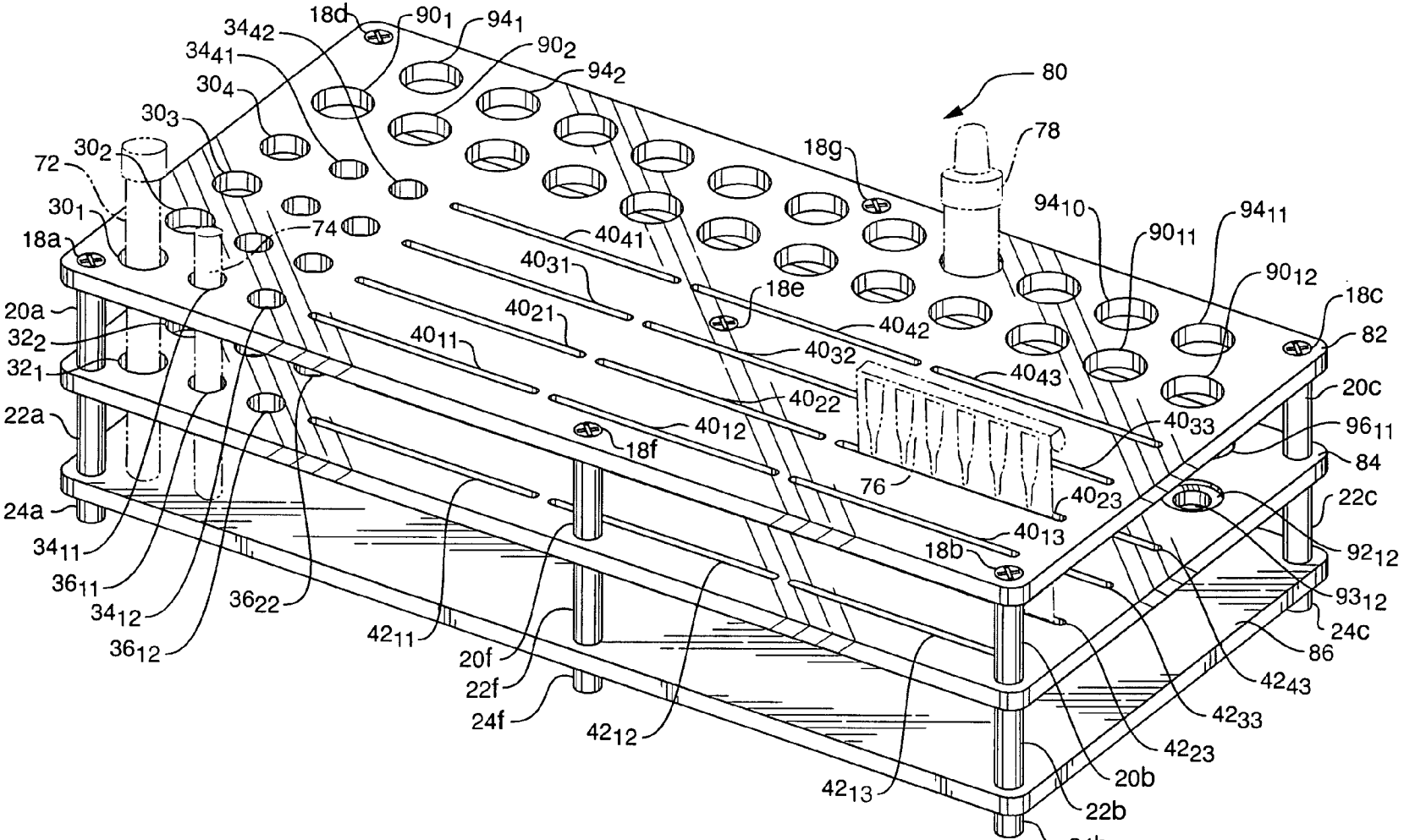
FIG. 11 is a front perspective view of a third embodiment or CU blood bank testing workstation according to the invention.
Figure 12:
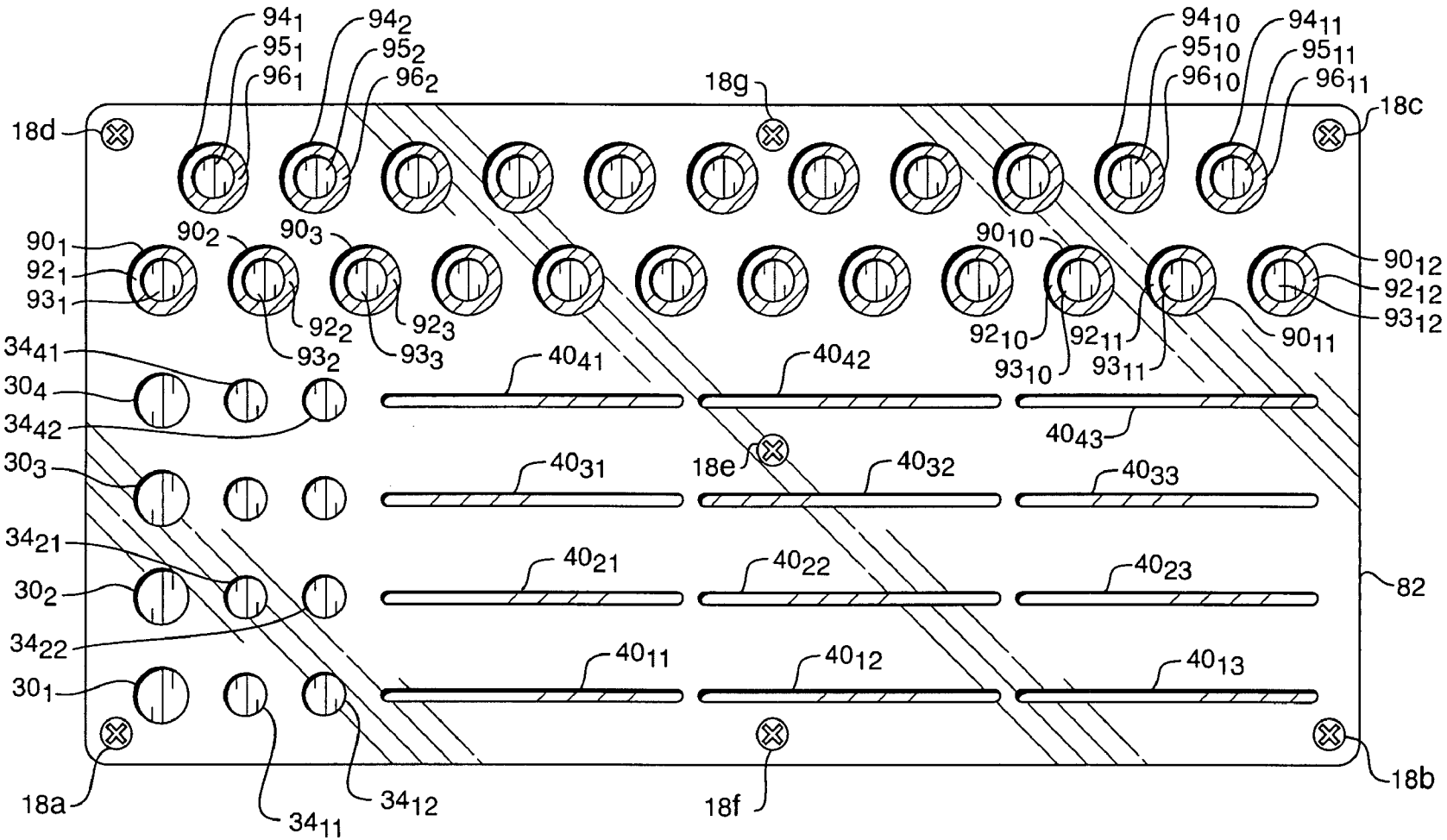
FIG. 12 is a top plan view of the CU workstation.
Figure 13:
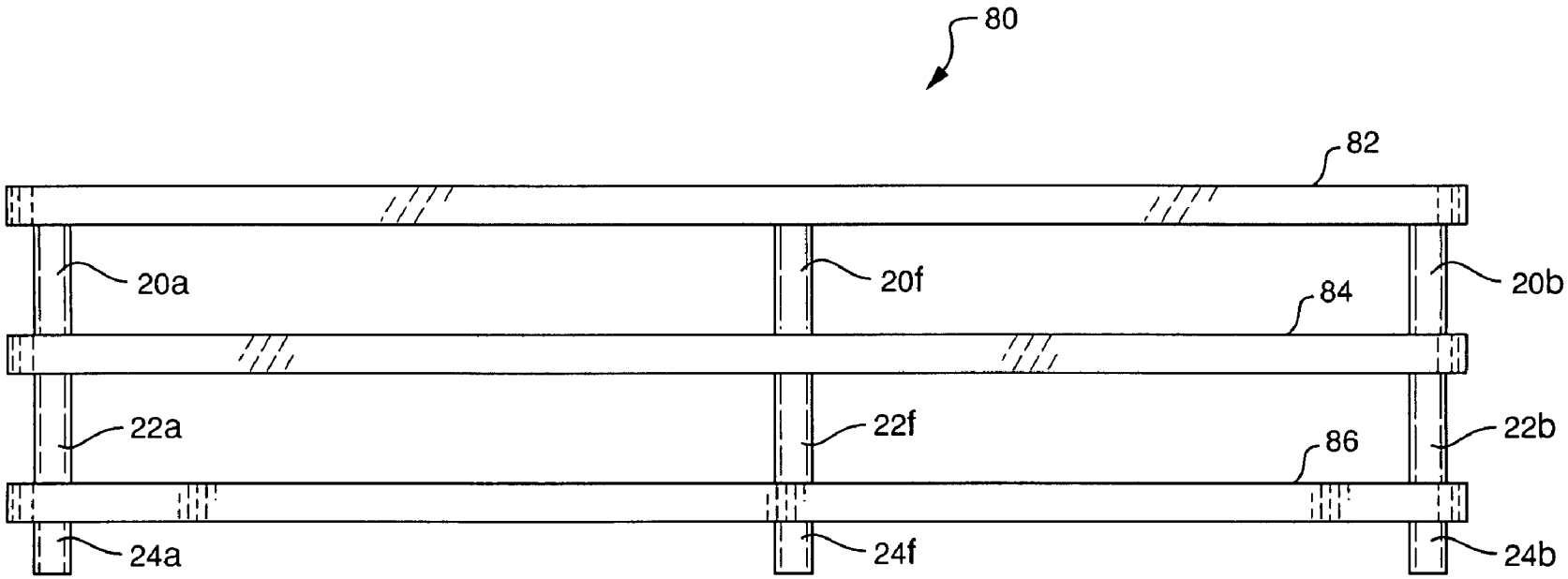
FIG. 13 is a front elevational view of the CU workstation.

Referring to FIG. 11, FIG. 12 and FIG. 13, FIG. 11 is a perspective view of a third embodiment of the blood bank testing workstation comprising a universal special studies platform or workstation 80 according to the present invention. It is referred to as a CU workstation 80 and is used for blood bank testing such as to perform up to 4 antibody ID panels at one time using gel-card technology. FIG. 12 is a top plan view of the CU workstation 80, and FIG. 13 is a front elevational view of the CU workstation 80. The CU workstation 80 comprises a top plate 82, a middle plate 84 and a bottom plate 86 arranged in separate, spaced apart horizontal planes parallel to each other. A first set of spacers 20*a*-20*g* are positioned around screws 18*a*-18*g* between the top plate 82 and the middle plate 84, and a second set of spacers 22*a*-22*g* are positioned around screws 18*a*-18*g* between the middle plate 84 and the bottom plate 86. Shorter spacers or standoffs 24*a*-24*g* on the bottom side of the bottom plate 84 are screwed on the ends of screws 18*a*-18*g* which are inserted into holes on the corners and across the central area of the top plate 82, the middle plate 84, and the bottom plate 86. The standoffs 24*e*-24*g* may be made slightly shorter than the corner standoffs 24*a*-24*d* to prevent rocking of the CU workstation 80 while on a flat surface during use.

The top plate 82 of the illustrative embodiment comprises a column of four holes $\mathbf{30}_1$-$\mathbf{30}_4$ each 16 mm in diameter, and an array of eight (8) smaller holes $\mathbf{34}_{11}$-$\mathbf{34}_{42}$ are provided adjacent to holes $\mathbf{30}_1$-$\mathbf{30}_4$, each hole being 12.5 mm in diameter. This array of smaller holes $\mathbf{34}_{11}$-$34_{42}$ comprises 2 holes in each row and 4 holes such as $\mathbf{34}_{11}$-$34_{41}$ in each column. Likewise, in the middle plate 84 the four holes $\mathbf{32}_1$-$\mathbf{32}_4$ are 16 mm in diameter suitable for receiving blood specimen tubes 72, and the eight (8) smaller holes $\mathbf{36}_{11}$-$\mathbf{36}_{42}$ are 12.5 mm in diameter, suitable for receiving standard test tubes 74.

Still referring to FIG. 11 and FIG. 12, the top plate 82 and the middle plate 84 each comprise thirty-five (35) holes and each hole in the top plate 82 is axially aligned directly above a correspondingly positioned hole in the middle plate 84. For example, hole $\mathbf{30}_1$, in a first row of the top plate 82 is directly above hole $\mathbf{32}_1$, in the middle plate 84. Likewise, in the same first row smaller holes $\mathbf{34}_{11}$-$\mathbf{34}_{12}$ in the top plate 82 are directly above corresponding holes $\mathbf{36}_{11}$-$\mathbf{36}_{12}$ in the middle plate 84. Behind the fourth row in top plate 82, which comprises hole $\mathbf{30}_4$ and smaller holes $\mathbf{34}_{41}$-$\mathbf{34}_{42}$, are two rows of larger holes $\mathbf{90}_1$-$\mathbf{90}_{12}$ and $\mathbf{94}_1$-$\mathbf{94}_{11}$ which extend the length of the workstation 80 and are 18 mm in diameter. In the middle plate 84 there are two rows of holes $\mathbf{92}_1$-$\mathbf{92}_{12}$ and $\mathbf{96}_1$-$\mathbf{96}_{11}$. The 18 mm holes $\mathbf{90}_1$-$\mathbf{90}_{12}$ and $\mathbf{94}_1$-$\mathbf{94}_{11}$, are provided to hold reagent bottles 78.

Each of the 12 holes $\mathbf{92}_1$-$\mathbf{92}_{12}$ and the 11 holes $\mathbf{96}_1$-$\mathbf{96}_{11}$ in the middle plate 84 is 18 mm in diameter and approximately 3 mm deep. The two rows of holes $\mathbf{90}_1$-$\mathbf{90}_{12}$ and $\mathbf{94}_1$-$\mathbf{94}_{11}$ in the top plate 82 are staggered or off-center relative to each row, and the two rows of holes $\mathbf{92}_1$-$\mathbf{92}_{12}$ and $\mathbf{96}_1$-$\mathbf{96}_{11}$ in the middle plate 84 are similarly off-center relative to each row. Each of the 18 mm holes $\mathbf{92}_1$-$\mathbf{92}_{12}$ and $\mathbf{96}_1$-$\mathbf{96}_{11}$ in the middle plate 84 comprises 12.5 mm through holes $\mathbf{93}_1$-$\mathbf{93}_{12}$ and $\mathbf{95}_1$-$\mathbf{95}_{11}$ which are on center with the 18 mm holes $\mathbf{92}_1$-$\mathbf{92}_{12}$ and $\mathbf{96}_1$-$\mathbf{96}_{11}$, and the 18 mm holes $\mathbf{92}_1$-$\mathbf{92}_{12}$ and $\mathbf{96}_1$-$\mathbf{96}_{11}$ are axially aligned under the 18 mm holes $\mathbf{90}_1$-$\mathbf{90}_{12}$ and $\mathbf{94}_1$-$\mathbf{94}_{11}$ in the top plate 82.

In addition to the thirty-five (35) holes in the top plate 82 and the corresponding thirty-five (35) holes in the middle plate 84, there are three columns of slots $\mathbf{40}_{11}$-$\mathbf{40}_{41}$, $\mathbf{40}_{12}$-$\mathbf{40}_{42}$ and $\mathbf{40}_{13}$-$\mathbf{40}_{43}$ in the top plate 82 and likewise there are three columns of slots $\mathbf{42}_{11}$-$\mathbf{42}_{41}$, $\mathbf{42}_{12}$-$\mathbf{42}_{42}$ and $\mathbf{42}_{13}$-$\mathbf{42}_{43}$ in the middle plate 84. This arrangement of slots in the top plate 82 and the middle plate 84 results in four test rows, each test row comprising, for example, in the first row of the top plate, a specimen hole $\mathbf{30}_1$, two test tube holes $\mathbf{34}_{11}$, $\mathbf{34}_{12}$ and three gel-card slots $\mathbf{40}_{11}$, $\mathbf{40}_{12}$ and $\mathbf{40}_{13}$. Likewise in the middle plate 84 the first row comprises the specimen hole $\mathbf{32}_1$, two test tube holes $\mathbf{36}_{11}$, $\mathbf{36}_{12}$, and three gel-card partial slots $\mathbf{42}_{11}$, $\mathbf{42}_{12}$ and $\mathbf{42}_{13}$. The first column of four slots $\mathbf{40}_{11}$-$\mathbf{40}_{41}$ is provided in the top plate 82, and the column of corresponding slots $\mathbf{42}_{11}$-$\mathbf{42}_{41}$ is provided in the middle plate 84, the slots $\mathbf{40}_{11}$-$\mathbf{40}_{41}$ in the top plate 82 being aligned directly above corresponding slots $\mathbf{42}_{11}$-$\mathbf{42}_{41}$ in the middle plate 84. The slots $\mathbf{40}_{11}$-$\mathbf{40}_{41}$ in the top plate 82 of the illustrated embodiment measure 2 mm×72 mm, extend completely through the top plate 82, and are suitably sized for receiving a standard gel-card. The slots $\mathbf{42}_{11}$-$\mathbf{42}_{41}$ in the middle plate 84 are not cut completely through the middle plate 84 and measure 2 mm×72 mm with a depth of approximately 3 mm. This enables the gel-card 76 inserted in one of the slots $\mathbf{40}_{11}$-$\mathbf{40}_{81}$ to extend above the top plate 82 for ease of use of the microtubes and to allow information on the gel-card to be easily read. Further in the top plate 82, the second column of four slots $\mathbf{40}_{12}$-$\mathbf{40}_{42}$ is adjacent to the first column of four slots $\mathbf{40}_{11}$-$\mathbf{40}_{41}$. Likewise, on the middle plate 84 slots $\mathbf{42}_{12}$-$\mathbf{42}_{42}$ are provided adjacent to the first column of four slots $\mathbf{42}_{11}$-$\mathbf{42}_{41}$, and slots $\mathbf{42}_{12}$-$\mathbf{42}_{42}$ are aligned directly under slots $\mathbf{40}_{12}$-$\mathbf{40}_{42}$. Also, slots $\mathbf{42}_{12}$-$\mathbf{42}_{42}$ in the middle plate 84 are not cut completely through the middle plate 84 and measure 2 mm×72 mm with a depth of approximately 3 mm.

The third column of four slots $\mathbf{40}_{13}$-$\mathbf{40}_{43}$ in the top plate 82 is adjacent to the second column of four slots $\mathbf{40}_{12}$-$\mathbf{40}_{42}$. Likewise on the middle slot 84 slots $\mathbf{42}_{13}$-$\mathbf{42}_{43}$ are provided adjacent to the second column of four slots $\mathbf{42}_{12}$-$\mathbf{42}_{42}$ and slots $\mathbf{42}_{13}$-$\mathbf{42}_{43}$ are aligned directly under slots $\mathbf{40}_{13}$-$\mathbf{40}_{43}$. Again, slots $\mathbf{42}_{13}$-$\mathbf{42}_{43}$ are not cut completely through the middle plate 84 and measure 2 mm×72 mm with a depth of approximately 3 mm.

The CU workstation 80 is designed structurally to be used to perform specialized testing in a blood bank including antibody identification, phenotype, and more complex testing using the gel-card technology. Workstation 80 allows a laboratory technologist to organize reagent bottles 78, patient specimen tubes 72, working test tubes 74 and gel-cards 76 in one central location and orienting them in a manner that facilitates accuracy and speed in testing such as providing a patient specimen tube 72, testing tubes 74 and gel-cards 76 in a single row on the workstation 80. Having the three columns of slots $\mathbf{40}_{11}$-$\mathbf{40}_{41}$, slots $\mathbf{40}_{12}$-$\mathbf{40}_{42}$ and slots $\mathbf{40}_{13}$-$\mathbf{40}_{43}$ on the middle plate 84 for receiving gel-cards 76 on the workstation 80 often eliminates the need for other racks or workstations making it easier for a technologist to see and load the microtubes of the gel-card 76 and avoid an error of planting a patient blood specimen in the wrong gel-card 76.

The advantage of workstation 80 is that it allows the technologist to store reagents in the workstation 80 and lines them up in the order in which they will be used. The 18 mm holes $\mathbf{90}_1$-$\mathbf{90}_{12}$ and $\mathbf{94}_1$-$\mathbf{94}_{11}$, which allow the reagents to be stored on the rack, do not pass completely through the middle plate 84 in order to accommodate shorter reagent bottles. The 12.5 mm holes $\mathbf{93}_1$-$\mathbf{93}_{12}$ and $\mathbf{95}_1$-$\mathbf{95}_{11}$, which are centered within holes $\mathbf{92}_1$-$\mathbf{92}_{12}$ and $\mathbf{96}_1$-$\mathbf{96}_{11}$ in the middle plate 84 beneath the 18 mm holes $\mathbf{90}_1$-$\mathbf{90}_{12}$ and $\mathbf{94}_1$-$\mathbf{94}_{11}$ in the top plate 82, are for laboratories which dilute their own reagents or aliquot reagents and store them in test tubes 74. (These tubes may also be stored in the workstation 80 when not in use). Another advantage is that it allows the technologist to work on multiple (up to 4) patient specimens at one time, and it lines-up each specimen in its own row and all the test tubes 74 and gel-cards 76 that it will need to perform extra testing.

Referring again to FIG. 11, the top plate 82 and the middle plate 84 are made of plastic and may be embodied by a Lexan® polycarbonate, manufactured by General Electric Company, or by a Hyzod® polycarbonate manufactured by Sheffield Plastics, Inc. The top plate 12 and the middle plate 14 are machined together to insure alignment of holes and slots by a CNC milling machine. The bottom plate 86 may be embodied by a plastic made of a high density polyethylene.

Referring to FIG. 12 and FIG. 13, FIG. 13 is a front elevational view of the workstation 80 showing the front left corner spacers 20*a*, 22*a*, the front right corner spacers 20*b*, 22*b*, and front center area spacers 20*f*, 22*f*. There are center spacers 20*e*, 22*e* located near the center area of the workstation 80, between slots $\mathbf{40}_{32}$ and $\mathbf{40}_{42}$, and rear spacers 20*g*, 22*g* (not shown) located in the rear center of the workstation 80. The screws 18*a*-18*g* at the corners and center areas of the workstation 80 may be embodied by commonly available stainless steel, flat head, Phillips machine screws having a 10-32 thread and a length of 2.5 inches. The spacers 20*a*-30*g*, 22*a*-22*g* at the four corners and the center areas of the workstation 80 may be embodied by commonly available Nylon unthreaded, round spacers having a ⅜ inch O.D., ¾ inch length #10 screw size.

Figure 14:
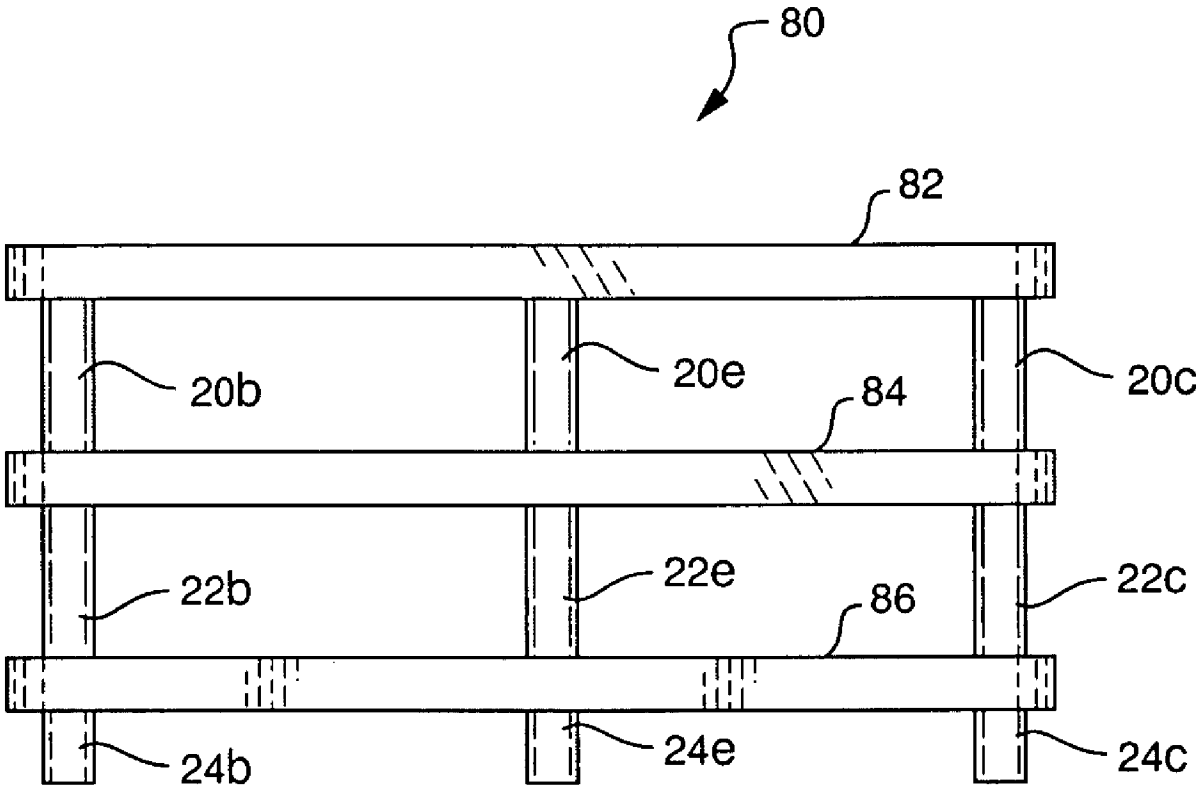
FIG. 14 is a right side elevational view of the CU workstation.

Referring to FIG. 11 and FIG. 14, FIG. 14 is a right side elevational view of the CU workstation 80 and shows the spacers 20*e*, 22*e* and standoff 24*e*, which are located between the slots $\mathbf{40}_{32}$ and $\mathbf{40}_{42}$, are slightly left of the center between the front spacers 20*b*, 22*b* (and 20*f*, 22*f*) and the rear spacers 20*c* and 22*c* (and 20*g*, 22*g*).

Figure 15:
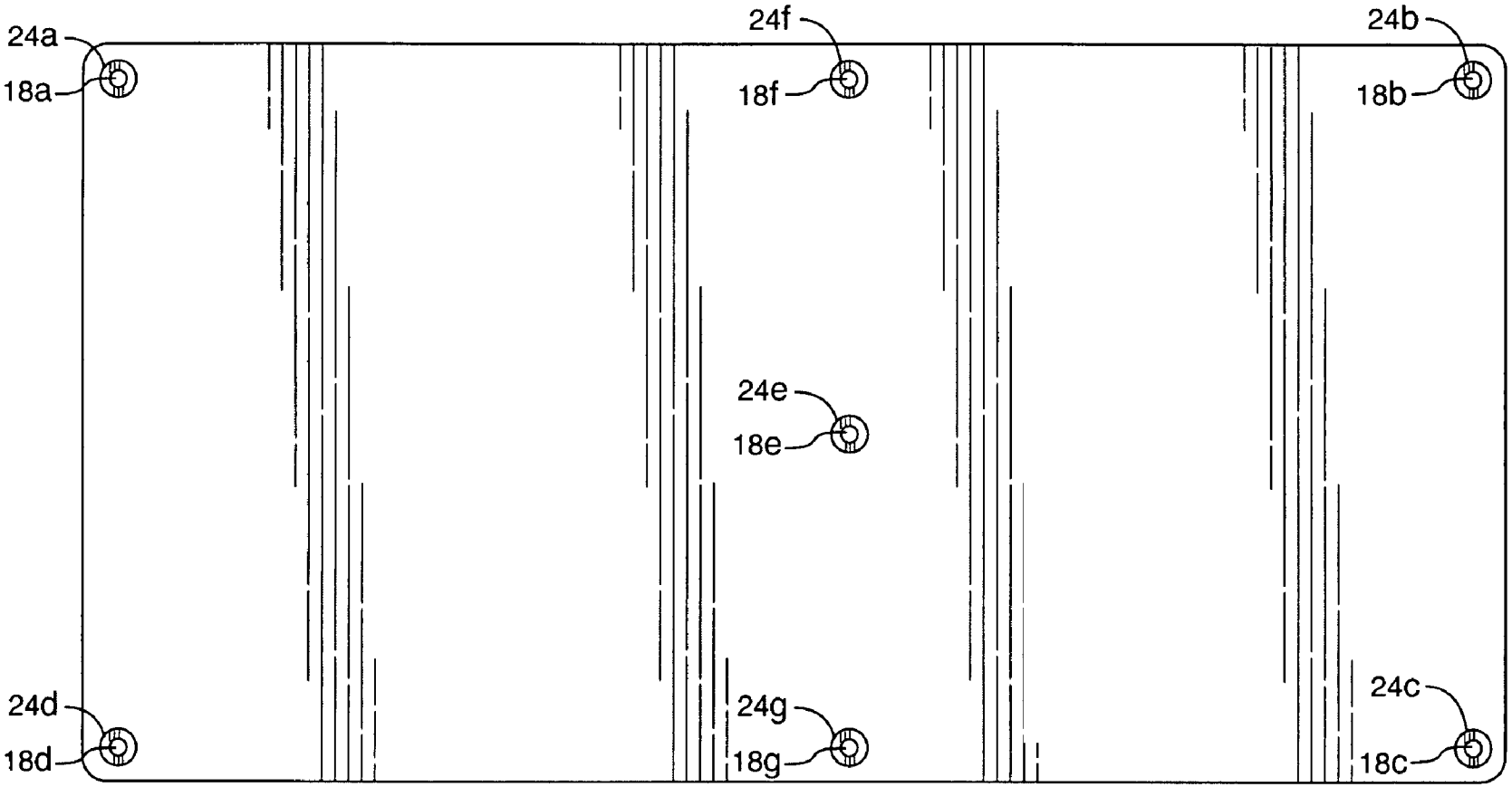
FIG. 15 is a bottom plan view of the CU workstation.

Referring to FIG. 11 and FIG. 15, FIG. 15 shows a bottom plan view of the CU workstation 80 comprising the bottom plate 86 and standoffs 24*a*-24*g*. The standoffs 24*a*, 24*g* are threaded and screwed onto the end of the 10-32 screws 18*a*-18*g*. The standoffs 24*a*-24*g* are commonly available nylon threaded, round standoffs having a ⅜ inch O.D., ⅜ inch length and 10-32 thread. As previously described, the bottom plate 86 provides a stop for articles such as specimen tubes 72 or test tubes 74 inserted into holes $\mathbf{30}_1$-$\mathbf{30}_4$ and $\mathbf{34}_{11}$-$34_{42}$ in the workstation 80.

The CU workstation 80 as shown in FIG. 11 measures 12.0 inches×6.5 inches×2.5 inches and is intended to accommodate four (4) patient specimens which are received by top plate holes $\mathbf{30}_1$-$\mathbf{30}_4$ and middle plate holes $\mathbf{32}_1$-$\mathbf{32}_4$. However, one of ordinary skill in the art will recognize that other dimensions for the CU workstation 80 may be implemented depending on a user laboratory requirement or preference without departing from the invention.

This invention has been disclosed in terms of certain embodiments. It will be apparent that many modifications can be made to the disclosed apparatus without departing from the invention. For example, each of the platform or workstation embodiments is designed for a particular application in the area of blood bank testing and the number of blood specimen holes and corresponding test rows which may be increased or decreased in each embodiment. Therefore, it is the intent of the appended claims to cover all such variations and modifications as come within the true spirit and scope of this invention.

What is claimed is:

1. A blood bank testing workstation comprising:

a top plate spaced above a middle plate and said middle plate spaced above a bottom plate;

each of said top plate and said middle plate comprises a matrix of holes, said matrix of holes in said top plate being aligned with said matrix of holes in said middle plate;

a first column of slots in said top plate positioned adjacent to said matrix of holes in said top plate;

a first column of slots in said middle plate positioned adjacent to said matrix of holes in said middle plate and aligned directly under said first column of slots in said top plate;

a second column of slots in said top plate adjacent to said first column of slots; and a second column of slots in said middle plate positioned adjacent to said first column of slots and aligned directly under said second column of slots in said top plate.

2. The blood bank testing workstation as recited in claim 1 wherein said workstation comprises a plurality of rows of said matrix of holes in said top plate and corresponding rows of said matrix of holes in said middle plate, each row comprises a first size hole of said matrix of holes, a plurality of second size holes of said matrix of holes, and said slots.

3. The blood bank testing workstation as recited in claim 1 wherein said column of slots in said top plate comprises a through slot, and said column of slots in said middle plate comprises a non-through slot.

4. The blood bank testing workstation as recited in claim 1 wherein said matrix of holes comprises a first column of a first size holes for receiving blood specimen tubes and an adjacent array of second size holes for receiving test tubes.

5. The blood bank testing workstation as recited in claim 1 wherein said platform comprises a plurality of screws for securing said top plate, said middle plate and said bottom plate together, said screws being inserted in first spacers between said top plate and said middle plate and second spacers between said middle plate and said bottom plate.

6. The blood bank testing workstation as recited in claim 5 wherein said pluralities of screws are screwed into standoffs on the bottom of said bottom plate.

7. The blood bank testing workstation as recited in claim 1 wherein said workstation comprises a plurality of third size through holes in said first plate adjacent to said matrix of holes, and a plurality of said third size holes in said middle plate aligned under said corresponding third size holes in said top plate, said third size holes in said middle plate being non-through holes.

8. A blood bank testing workstation comprising:

a top plate spaced above a middle plate and said middle plate spaced above a bottom plate;

each of said top plate and said middle plate comprises a matrix of holes, said matrix of holes in said top plate being aligned with said matrix of holes in said middle plate;

a first column of slots in said top plate positioned adjacent to said matrix of holes in said top plate;

a first column of slots in said middle plate positioned adjacent to said matrix of holes in said middle plate and aligned directly under said first column of slots in said top plate;

a plurality of third size through holes in said first plate adjacent to said matrix of holes; and a plurality of said third size holes in said middle plate aligned under said corresponding third size holes in said top plate, said third size holes in said middle plate being non-through holes.

9. The blood bank testing workstation as recited in claim 8 wherein a row of second size holes are positioned on said top plate in the same row as said third size holes and adjacent to said first column and said second column of slots; and a row of said second size holes are positioned in said middle plate aligned under said corresponding second size holes in said top plate.

* * * * *